US008429940B2

(12) United States Patent
Evans

(10) Patent No.: US 8,429,940 B2
(45) Date of Patent: Apr. 30, 2013

(54) ARMOURED CABLE ASSEMBLIES, LOCKING ASSEMBLIES, MOUNTING SYSTEMS AND ANCHORS

(75) Inventor: David John Evans, Mascot (AU)

(73) Assignee: Tyson Security Pty Limited, Mascot, New South Wales (AU)

( * ) Notice: Subject to any disclaimer, the term of this patent is extended or adjusted under 35 U.S.C. 154(b) by 1301 days.

(21) Appl. No.: 11/912,139

(22) PCT Filed: Apr. 19, 2006

(86) PCT No.: PCT/AU2006/000520

§ 371 (c)(1),
(2), (4) Date: May 8, 2008

(87) PCT Pub. No.: WO2006/110951

PCT Pub. Date: Oct. 26, 2006

(65) Prior Publication Data

US 2009/0025433 A1 Jan. 29, 2009

(30) Foreign Application Priority Data

Apr. 19, 2005 (AU) ..... 2005901953

(51) Int. Cl.
*E05B 67/06* (2006.01)

(52) U.S. Cl.
USPC ..... 70/49; 70/52; 70/360; 70/368; 70/371; 70/380

(58) Field of Classification Search ..... 70/49, 367–369, 70/371, 52, 233, 360, 370, 379 R, 379 A, 70/380
See application file for complete search history.

(56) References Cited

U.S. PATENT DOCUMENTS 1,380,719 A * 6/1921 Johnson ..... 70/49
1,386,778 A * 8/1921 Gray ..... 70/49

(Continued)

OTHER PUBLICATIONS

International Search Report dated Jun. 1, 2006 for Application No. PCT/AU2006/000520.

(Continued)

*Primary Examiner* — Lloyd Gall
(74) *Attorney, Agent, or Firm* — Alston & Bird LLP

(57) ABSTRACT

An armored cable assembly (10) includes a flexible cable (12), a plurality of first armor elements (14), and a plurality of second armor elements (20). The flexible cable (12) is received within a bore (16, 28) in each of the armor elements (14, 20), which are threaded in alternate manner on the flexible cable (12). A ball and socket joint is established between adjacent armor elements (14, 20). Each of the second armor elements (20) includes a cylindrical portion (22) between first and second arcuate or hemispherical ends (24), each end (24) being adapted to provide the ball of the ball and socket joint. A locking assembly (50) is further provided for use with an armored cable assembly. The locking assembly (50) includes a lock body (52), a lock housing (54), a rotatable locking mechanism (56) operable by a key, a disk (60) rotatable to a first locked position, a second unlocked position and a third position in which the lock housing (54) is removable from the lock body (52), and a movable retainer (84) to control rotation of the disk (60) to the third position. An anchor (170) having a housing (172) having a base (174) for securing to a substrate by a fastener (178) is also provided. An aperture (180) passing through the housing (172) is generally parallel to the base (174). A cover (192) is adapted to restrict access to the fastener (178) when the aperture (180) is occupied by a cable, chain, shackle or the like.

8 Claims, 10 Drawing Sheets

U.S. PATENT DOCUMENTS

| | | | | | |
|---|---|---|---|---|---|
| 1,539,301 | A | * | 5/1925 | Cooper | 70/49 |
| 3,728,879 | A | * | 4/1973 | Best | 70/38 R |
| 3,765,196 | A | | 10/1973 | Balicki | |
| 3,855,824 | A | * | 12/1974 | Falk | 70/38 A |
| 3,933,015 | A | | 1/1976 | Balicki | |
| 4,075,878 | A | * | 2/1978 | Best | 70/49 |
| 4,202,587 | A | * | 5/1980 | Wieland | 312/219 |
| 4,438,641 | A | * | 3/1984 | Levkov | 70/95 |
| 4,548,061 | A | * | 10/1985 | Nilsson | 70/370 |
| 4,809,525 | A | * | 3/1989 | Cox | 70/100 |
| 4,926,670 | A | * | 5/1990 | Deforrest, Sr. | 70/374 |
| 5,010,753 | A | * | 4/1991 | Boris, Jr. | 70/371 |
| 5,274,353 | A | | 12/1993 | Bianchi | |
| 5,363,678 | A | * | 11/1994 | Meckbach | 70/38 A |
| 5,377,511 | A | * | 1/1995 | Meckbach | 70/38 A |
| 5,577,408 | A | * | 11/1996 | Roos | 70/370 |
| 5,873,272 | A | * | 2/1999 | Thompson | 70/100 |
| 6,564,603 | B1 | * | 5/2003 | O'Neill | 70/380 |
| 2003/0217575 | A1 | * | 11/2003 | Price | 70/493 |
| 2005/0183475 | A1 | * | 8/2005 | Liu | 70/49 |

OTHER PUBLICATIONS

International Preliminary Report on Patentability dated Oct. 23, 2007 for Application No. PT/AU206/000520.

* cited by examiner

A-A

FIG. 27
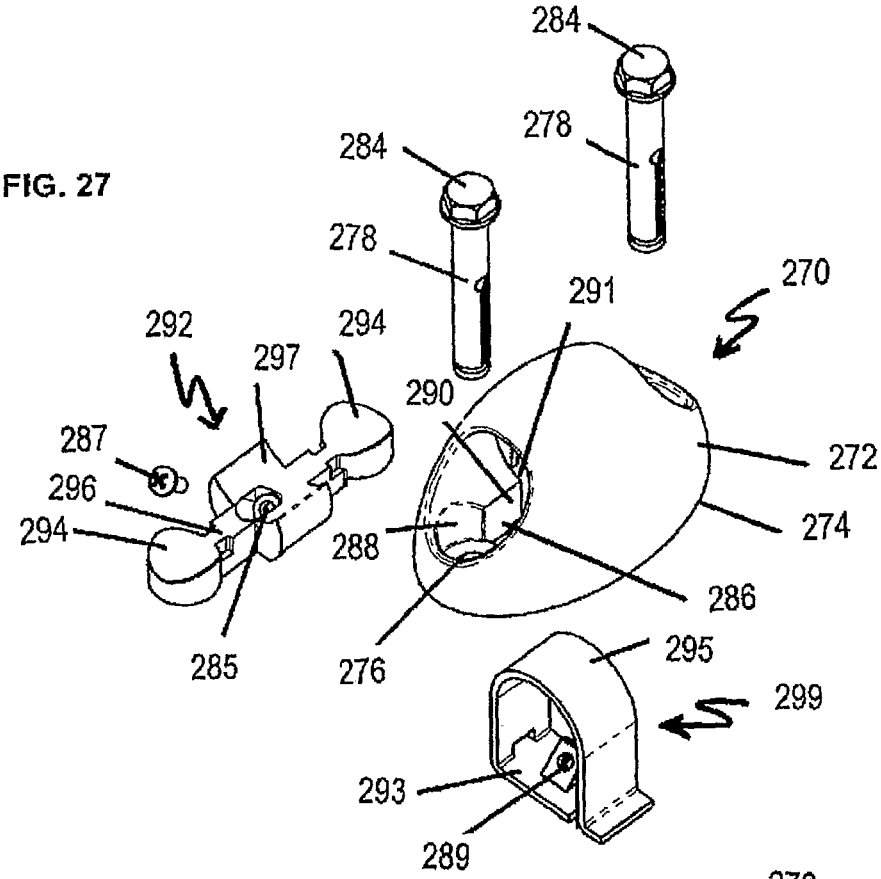
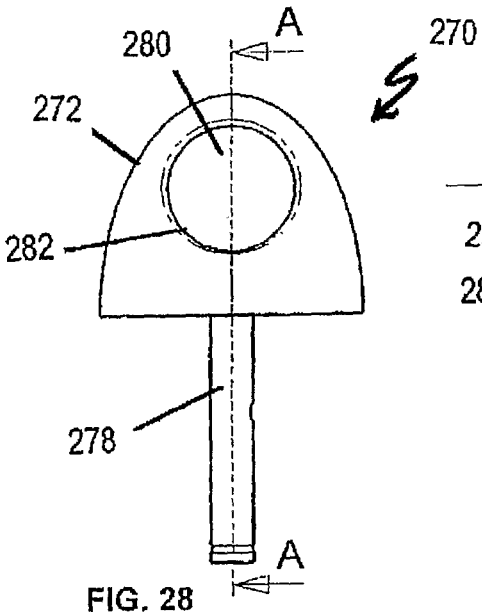
FIG. 28
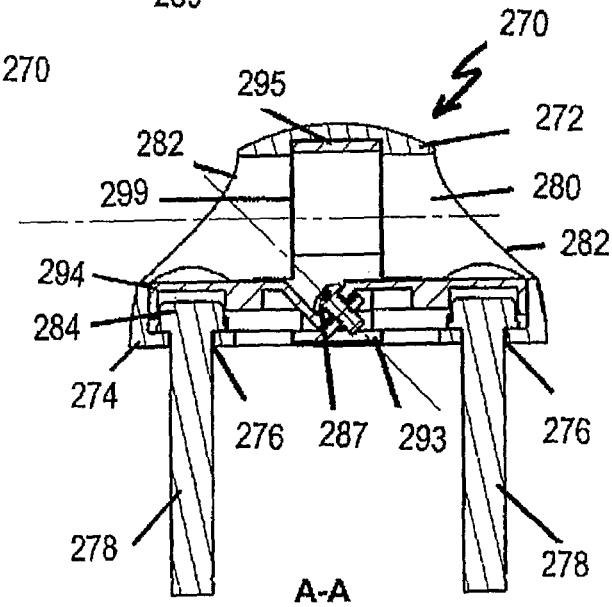
FIG. 29

ARMOURED CABLE ASSEMBLIES, LOCKING ASSEMBLIES, MOUNTING SYSTEMS AND ANCHORS

FIELD OF THE INVENTION

This invention is concerned with armoured cable assemblies, locking assemblies, mounting systems and anchors. In particular, the invention relates to assemblies, mounting systems and anchors which represent a considerable improvement over conventional chain and padlock assemblies and anchors therefor.

BACKGROUND OF THE INVENTION

Conventional chain and padlock assemblies have been used in many applications for a number of years. It is usual to provide an open-linked chain and to secure this by passing the shackle of a padlock through two links of the chain. Conventional chain and padlock assemblies are frequently used in this way to secure gates or to secure equipment such as bicycles, motor vehicles or other items to a fixed object or heavy article, such as to posts or street furniture, or to anchors specifically provided for this purpose.

The conventional chain and padlock assembly has many drawbacks. For example, if the chain is of insufficient diameter or hardness, it may be cut by a suitable tool, such as a bolt cutter or hacksaw. Similarly, if the shackle on the padlock is insufficiently robust, it may be cut by a tool such as a bolt cutter. Some padlocks can be smashed or wedged open with relatively little difficulty.

It may be difficult to preserve security using a conventional chain and padlock assembly. For example, a builder may seek to protect security on a building site by surrounding the building site with a wire mesh fence and providing access only through a gate, which can be locked to the fence using a conventional chain and padlock. Apart from the weaknesses in the conventional chain and padlock assemblies referred to above, the security can be compromised if the last worker to leave the site on the day chooses to lock up the site by inserting his own padlock between the chain and the builder's padlock. This gives the worker access to the site at any time, removing control of access from the builder.

In an attempt to overcome these drawbacks, the prior art has provided lockable cables. Because these do not use open links, and because they can be provided in an armoured cable form, they can be less vulnerable to cutting or sawing than conventional open-linked chains. Further, the prior art lockable cables can be locked using an integrated keyed lock, thus eliminating the drawbacks which can be encountered with padlocks.

One such prior art locking cable is disclosed in U.S. Pat. No. 3,933,015. This discloses a flexible stranded cable on which are threaded, in a bead-like fashion, alternate ball members and socket members. As admitted in U.S. Pat. No. 3,933,015, this assembly has a weakness in that it may be possible to displace a ball member so as to expose some of the stranded cable and permit cutting of the cable with a hacksaw or other suitable tool. Once the cable is cut, all the ball members and socket members can be stripped from the cable, rendering the assembly useless as a high security device.

DISCLOSURE OF THE INVENTION

The present invention, in a first aspect, aims to overcome or substantially alleviate this problem encountered in the prior art armoured cable.

Accordingly, in a first aspect, this invention provides an armoured cable assembly having:

a flexible cable;

a plurality of first armour elements; and a plurality of second armour elements;

wherein the flexible cable is received within a bore in each of the first armour elements and second armour elements, which are threaded in alternate manner on the flexible cable, and wherein a ball and socket joint is established between each adjacent first armour element and second armour element, characterised in that the second armour element includes a cylindrical portion between first and second arcuate or hemispherical ends, each end adapted to provide the ball of the ball and socket joint.

Preferably, the flexible cable of the armoured cable assembly of the invention is a stranded steel cable. It is also preferred that the first armour elements and second armour elements are made from case hardened steel of sufficient thickness to provide high resistance to prying, hacksawing and bolt cutting.

The second armour element preferably resembles an elongated sphere having a central bore. An example is shown in connection with the drawings, below. The cylindrical portion of the second armour element may be particularly designed for locking in the lock assembly of the second aspect of the invention, described below. It is within the scope of the invention that the first armour element includes a recessed portion for the same purpose. Otherwise, the first armour element is preferably substantially cylindrical.

The armoured cable assembly of the invention may be provided in any suitable length. Examples are 60 cm (2 feet), 90 cm (3 feet), 120 cm (4 feet) and 180 cm (6 feet).

The flexible cable may be secured in the armoured cable assembly of the invention in any suitable way. As a non-limiting example, each end of the flexible cable may be inserted in a metal tube and constrained therein by swaging. In this embodiment, the metal tube preferably terminates in a screw thread receivable in a complementary thread in the end of the armoured cable assembly. Screw fixing of the cable end provides additional security against attempts to pull the flexible cable out of the end of the armoured cable assembly.

It is further preferred that the flexible cable is sealed within the assembly by further means, such as blind fixing means. One example of such means is a steel pin, of hardened steel where it is to contact the flexible cable and of soft steel externally, so that it may be flattened by impact to conform with the external periphery of the assembly. As a different example, the blind fixing means may be a bifurcated pin adapted to flare out following impact.

As mentioned above, it is preferred that each of the first armour element and the second armour element includes a recessed portion for locking. It will be appreciated by one skilled in the art that this construction enables incremental locking of the armoured cable assembly of the invention, especially when the cable assembly is used with the locking assembly described below.

The second aspect of the present invention is concerned with a locking assembly suitable for use with the armoured cable assembly of the first aspect of the invention, but not necessarily limited thereto. The invention in the second aspect is concerned with a locking system, which allows for a locking mechanism to be extracted from the locking assembly when in the unlocked position, with the use of a key. The purpose of this is to allow for re-keying or upgrading of the locking mechanism as required.

Accordingly, in the second aspect, this invention provides a locking assembly suitable for use with an armoured cable assembly, the locking assembly including:

a look body;

a lock housing receivable within the lock body;

a locking mechanism operable by a key and rotatably mounted within the lock housing; and a disk rotatable by the locking mechanism when operated by the key to a first locked position, a second unlocked position and a third position in which the lock housing is removable from the lock body;

wherein the locking assembly includes movable retaining means to control rotation of the disk to the third position.

As indicated above, the locking assembly of the invention is preferably suitable for use with the armoured cable assembly of the first aspect of the invention. However, the locking assembly of the invention is not necessarily limited to this application.

The lock body is preferably generally cylindrical or elliptical and the lock housing is similarly preferably generally cylindrical or elliptical so as to be receivable within the lock body.

The locking mechanism may be any suitable locking mechanism, including a pin tumbler or disk tumbler locking mechanism, in each case operable by a key.

The rotatable disk preferably includes an aperture, as well as peripheral cutouts appropriate to the first, second and third positions to which the disk is rotatable.

The movable retaining means is preferably a pin which, when withdrawn, permits the disk to be rotated to the third position and thus allows the lock housing to be fully removed from the lock body. Subsequently, the locking assembly can be re-keyed or replaced.

It is further preferred that when the disk is rotated by the locking mechanism operated by the key to the second position, the lock housing can be partially extracted from the lock body. The pin is preferably accessible when the disk returns to the first locked position. In this configuration, it is preferred that the pin can be located through a suitable aperture in the side of the lock housing. The pin may be manipulated by a pick or other suitable tool to move the pin out of contact with the disk, whereupon the disk can rotate to the third position in which the lock housing can be removed entirely from the lock body.

It is preferred that the lock body is cast in stainless steel or made of case-hardened steel and utilises a number of case-hardened steel pins, strategically placed within the lock body to give a high resistance to prising and hacksawing. If desired, some or all of the components of the lock assembly may be zinc or chrome-plated to give good resistance to corrosion.

Preferably, the locking mechanism is of a "deadlock" design as opposed to a "snap-lock" design. The purpose of this is to prevent the lock from being rapped open or otherwise prised open. It can also assure the key holder that the system will not be locked without authority. However, it is within the scope of the invention that the locking assembly may be converted from a "deadlock" design to a "snaplock" design and vice versa.

The locking assembly of the invention in the second aspect, together with an armoured cable assembly, particularly that of the first aspect of the invention, is particularly suitable for securing motor cycles, trailers, caravans, boats and gates.

In a third aspect, this invention is concerned with a lock mount assembly which can be used with the armoured cable assembly of the first aspect of the invention, although the third aspect of the invention is not limited to this application. The lock mount assembly is preferably suitable for mounting on a gate or to a solid wall or frame or to the ground or to a similar position.

Accordingly, in the third aspect, this invention provides a lock mount assembly including:

a housing having a first aperture for receipt of a first cable end and a second aperture for receipt of a second cable end;

a locking mechanism operable by a key and rotatably mounted within the housing;

a disk rotatable by the locking mechanism when operated by the key to a first locked position and a second unlocked position;

means for engaging the first cable end inserted in the first aperture in the locked position; and means permitting disengagement of the second cable end received in the second aperture in the unlocked position.

Preferably, the housing is made from stainless steel and utilises a number of case-hardened steel pins, strategically placed within the lock mount assembly to give a high resistance to prising and hacksawing. If desired, some or all of the components of the lock mount assembly may be zinc or chrome-plated to give good resistance to corrosion. Preferably the housing includes a base for mounting onto a gate, or to a solid wall or frame, or to a concrete base, with two or more mounting screws. Preferably the mounting screws are not accessible when the first and second cable ends are locked in the apertures, but, especially where there are two mounting screws, can be accessed when the first and second cable ends are removed from the first and second apertures, after unlocking the lock mount assembly.

In most cases, the first cable end and the second cable end will comprise two ends of a single cable assembly. However, the invention is not necessarily limited to this embodiment.

The locking mechanism may be any suitable locking mechanism, including a pin tumbler or disk tumbler locking mechanism, in each case operable by a key. Preferably, the locking mechanism is of a "deadlock" design as opposed to a "snap-lock" design. The purpose of this is to prevent the lock from being rapped open or otherwise prised open. It can also assure the key holder that the system will not be locked without authority.

The disk rotatable by the locking mechanism preferably is concerned with the means for engaging the first cable end inserted in the first aperture in the locked position. It is preferred that the disk is attached to or integral with a cam pin which can engage a cam groove in a plate which in turn controls means such as a tongue. When the lock mount assembly is in the locked position, the rotation of the disk via the cam pin and cam groove operate to lift the plate and the tongue to engage the first cable end and thus secure it within the aperture. When the key is used to unlock the locking mechanism, the disk rotates, the cam pin in the cam groove is lowered and the plate permits the tongue to disengage from the first cable end. Hence the first cable end can be withdrawn from the first aperture.

The means for permitting disengagement of the second cable end received in the second aperture in the unlocked position preferably includes two further tongues which disengage from the second cable end when the locking mechanism operated by the key has been rotated to the unlocked position.

It is particularly preferred that the plate controlling the first tongue adapted to engage the first cable end also operates in connection with disengagement of the second cable end. As will be seen from the example described below in connection with the drawings, the plate may have apertures adapted to align with similar apertures on a base plate. When the key has been rotated to the unlocked position, pins or projections associated with the two further tongues may be received in the aligned apertures, so that the tongues move out of engagement with the second cable end.

It is also particularly preferred that the two further tongues are biased towards engagement with the second cable end and that the tongues need to be pushed towards the aligned apertures, using a pick or other suitable tool, against the bias. The purpose of this is that the second cable end will normally be retained within the lock mount assembly of the invention unless it is desired to change the second cable. Normally, when locking and unlocking the lock mount assembly of the invention, it will be necessary only to manipulate the first cable end, permitting the second cable end to remain fixed in position.

It is preferred that the components of the lock mount assembly are zinc or chrome plated or otherwise treated to give good resistance to corrosion.

It will be appreciated that the lock mount assembly of the invention can be particularly suitable for securing motor cycles, trailers, caravans, boats and other "hard to lock" items. It is also ideal for securing gates with round or square posts, or a combination of both. The lock mount assembly of the invention may be provided with part of the housing shaped to accommodate a round post. Alternately, an adaptor may be provided so that a look mount assembly designed for a square post may be secured to a round post.

In a fourth aspect, this invention provides an anchor which is suitable for use with a cable, including the armoured cable assembly of the first aspect of the invention. Accordingly, in a fourth aspect, this invention provides an anchor, including:

a housing having a base adapted to be secured to a substrate by fastening means;

an aperture passing through the housing, the aperture being generally parallel to the base; and a cover for the fastening means;

wherein, in use, the cover is adapted to restrict access to the fastening means when the aperture is occupied by a cable, chain, shackle or the like.

It is preferred that the anchor is made of case-hardened steel

Preferably, the housing is of a generally elliptical dome-like shape and is intended to be secured to a substrate, such as concrete, a floor or similar sturdy surface, by a pair of suitable bolts.

It is especially preferred that the base of the housing is shaped so that the bolts can be set into the base and that the base is shaped to receive the cover by way of close fit. The cover may be in one or more parts. For example, in the embodiment where the housing is secured to the substrate by a pair of suitable bolts, each bolt may be set separately into the base of the housing and a separate cover part may be provided for each bolt. In another embodiment, the cover may be in a single part, having a first portion covering one bolt and a second portion covering the second bolt, the portions being joined by a bridge.

It is preferred that the cover, especially when it is in a single part, is secured in place within the housing. This may be effected in any suitable way. By way of example, the anchor may include a member designed to fit snugly within the housing and adapted to receive the cover. Preferably, the cover can be fixed to the member, for example by use of a screw. An example is illustrated in the drawings, below. It will be appreciated that this preferred embodiment may contribute to preventing manipulation of the bolts when the cover is in place, secured to the member.

It is particularly preferred that the aperture passing through the housing is shaped so as to allow direct vertical access to each fastening means. This greatly facilitates fixing of the fastening means to the substrate. It is further preferred that the aperture is of an appropriate dimension so that a suitably-sized cable, chain, shackle or the like, when it occupies the aperture, cannot be moved sufficiently to enable the cover to be removed while the cable, chain, shackle or the like is in place.

If desired, the cover may include an o-ring or other means providing a friction-fit between the cover and the housing. The purpose of this is to help to retain the cover in the housing where it is not desired to remove the cover. For instance, the anchor of the invention may be mounted vertically on the substrate. Once the fastening means has been inserted and the cover pushed into place, it is convenient if the cover remains in place whether or not a cable, chain, shackle or the like is inserted in the aperture.

It will be appreciated that the anchor of the invention is designed so that, when a cable, chain, shackle or the like is inserted through the aperture, there is no access to the fastening means because the cable, chain, shackle or the like bears on the cover, preventing access to the fastening means. This preserves the security of the anchor device in order to prevent removal of the anchor device from the substrate in order to misappropriate the item which is secured by the anchor.

BRIEF DESCRIPTION OF THE DRAWINGS

The invention will now be described in relation to certain non-limiting examples thereof, described below in connection with the accompanying drawings, in which:

FIG. 27 is a perspective view of the components of a second embodiment of the anchor according to the fourth aspect of the invention;

FIG. 28 is a side elevation of the anchor of FIG. 27, assembled; and

FIG. 29 is a cross sectional view of FIG. 28 through section line A-A.

DETAILED DESCRIPTION OF THE DRAWINGS

Figure 1:
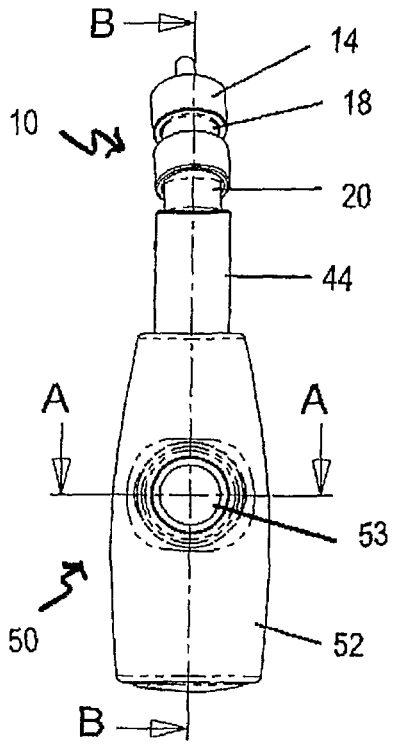
FIG. 1 is a side elevation of an embodiment of the locking assembly according to the second aspect of the invention, and including part of an embodiment of an armoured cable assembly according to the first aspect of the invention.
Figure 2:
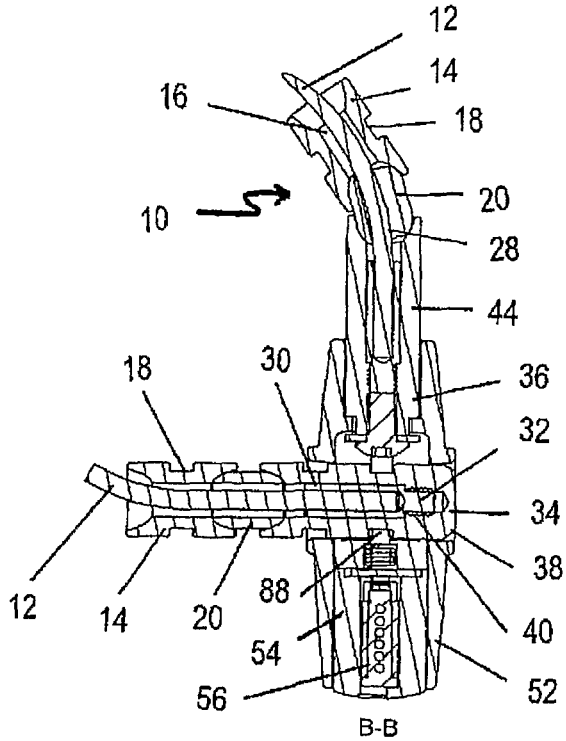
FIG. 2 is a cross-sectional view of the assembly of FIG. 1, through section line B-B.
Figure 3:
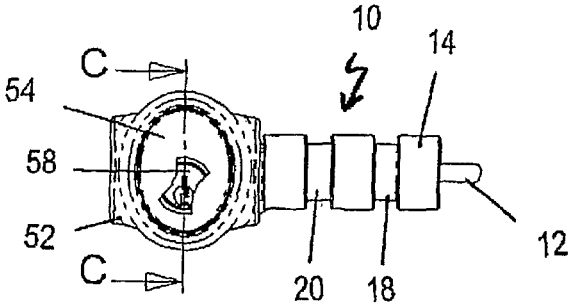
FIG. 3 is a front elevation of the locking assembly and armoured cable assembly of FIGS. 1 and 2.
Figure 4:
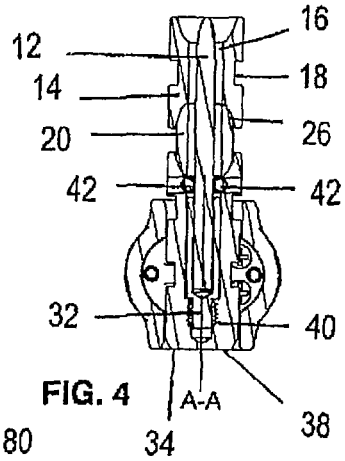
FIG. 4 is a cross-sectional view of FIG. 1 through section line A-A.
Figure 5:
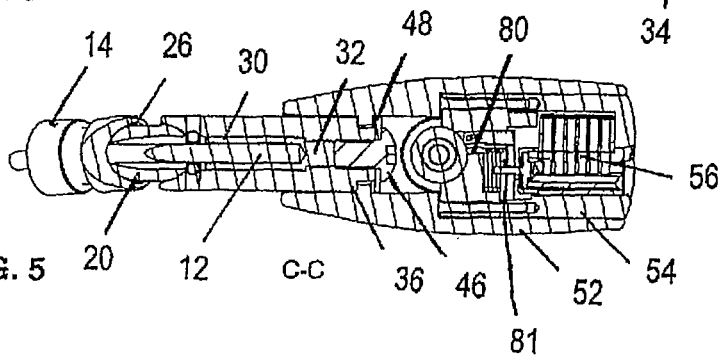
FIG. 5 is a cross-sectional view of FIG. 3 through section line C-C.

Turning first to FIGS. 1 to 6, armoured cable assembly 10 includes a flexible cable 12 of stranded steel (refer particularly FIGS. 2, 4 and 5). Cable assembly 10 has number of first armour elements 14 being substantially cylindrical and having a central bore 16 for receiving flexible cable 12. First armour element 14 also includes an external locking recess 18.

Figure 6:
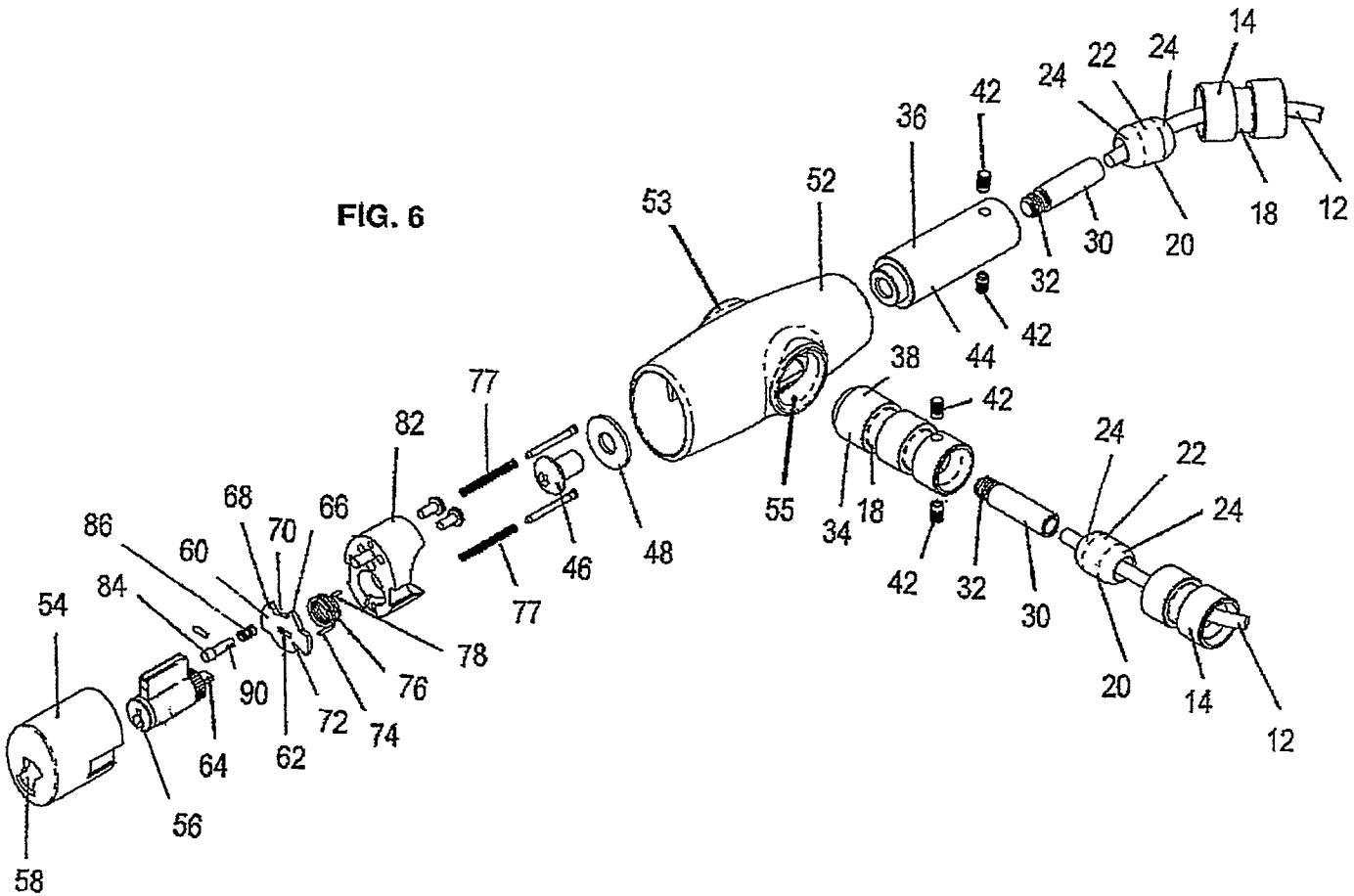
FIG. 6 is an exploded perspective view of the locking assembly and armoured cable assembly of FIGS. 1 to 5.

Second armour element 20 resembles an elongated sphere having a central cylindrical portion 22 between hemispherical portions 24 (refer FIG. 6). Each hemispherical portion 24 forms the "ball" of a ball and socket joint with socket 26 in first armour element 14.

First armour element 14 and second armour element 20 is each made from case hardened steel and is of considerable thickness, as can be seen in particular from FIGS. 2 and 4.

Second armour element 20 has a central bore 28 to receive flexible cable 12. Flexible cable 12 is received within, alternately, first armour elements 14 and second armour elements 20. Hemispherical portion 24 of second armour element 20 can rotate within socket 26 of first armour element 14 in a typical ball and socket joint assembly, so that armoured cable assembly 10 is relatively flexible.

Each end of flexible cable 12 is secured by swaging within metal tube 30. Metal tube 30 includes screw projection 32.

In the embodiment shown in FIGS. 1 to 8, armoured cable assembly 10 is designed for use with locking assembly 50. As a consequence, the ends of flexible cable 12 are different from each other. It is to be understood that the armoured cable assembly of the invention may have other forms of ends for other purposes.

In the form shown in FIGS. 1 to 8 of the drawings, armoured cable assembly 10 has first end 34 adapted to be received in and locked into locking assembly 50 and to be removable therefrom when unlocked. Armoured cable assembly 10 has second end 36 which is not intended to be normally removable from locking assembly 50.

First end 34 includes end housing 38 in which cable 12 is secured by two means. The first is the screw fit between screw projection 32 (on metal tube 30) and internal screw threads 40. The second is blind fixing by pins 42 forming an interference fit with flexible cable 12. Pins 42 are hammered flush with end housing 38.

Second end 36 of armoured cable assembly 10 includes end housing 44 in a similar manner, in that screw projection 32 is received within internal screw thread 40 and cable 12 is further secured by blind fixing pins 42. However, in the case of end housing 44, bolt 46 and nut 48 secure end housing 44 and hence end 36 within looking assembly 50.

Figure 7:
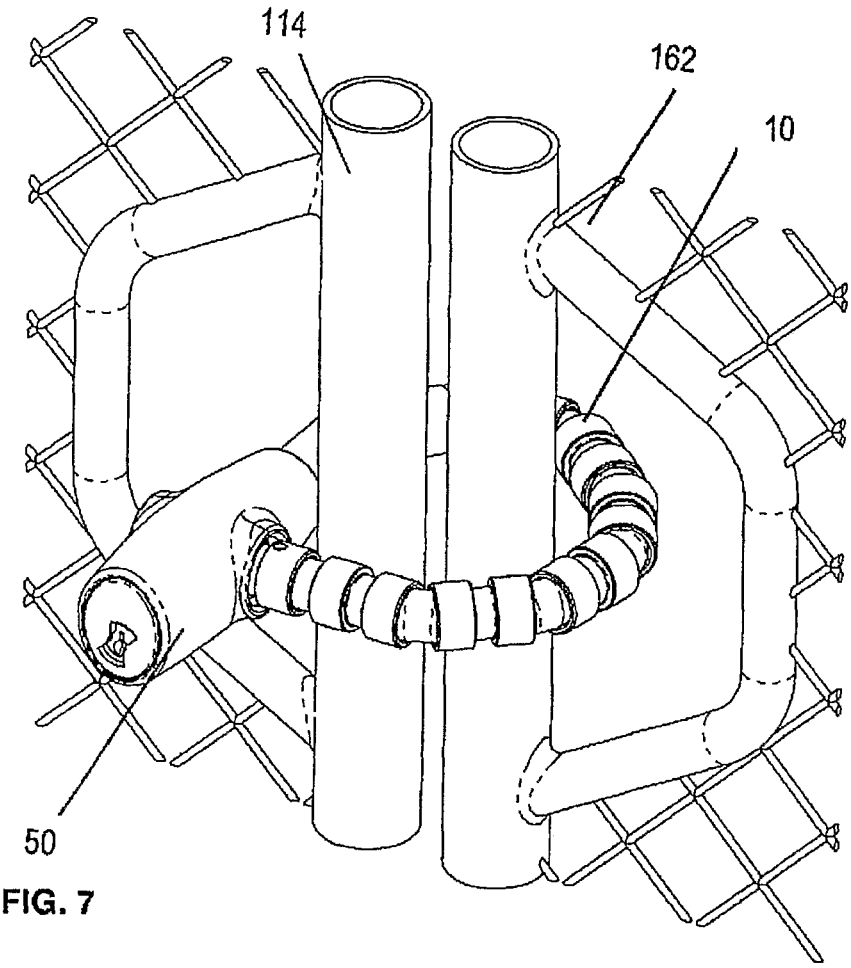
FIG. 7 is a perspective view of the locking assembly and armoured cable assembly of the previous Figures, mounted on a pair of gates.
Figure 8:
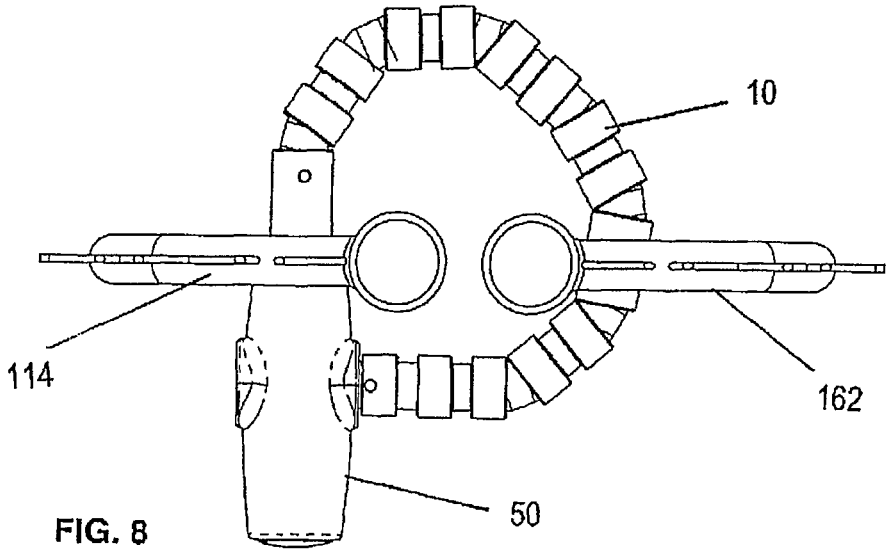
FIG. 8 is a top view of FIG. 7.

Although only the first few segments 14 and 20 of armoured cable assembly 10 are shown in the drawings, it is to be appreciated that armoured cable assembly 10 may be of any desired length. A relatively short version of armoured cable assembly 10 is shown in FIGS. 7 and 8.

Figure 9:
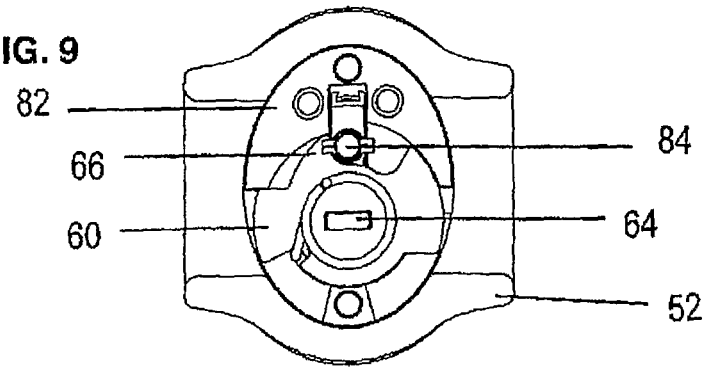
FIG. 9 is a cross-sectional view of FIG. 1 through section line A-A, showing the disc in the first or locked position.
Figure 10:
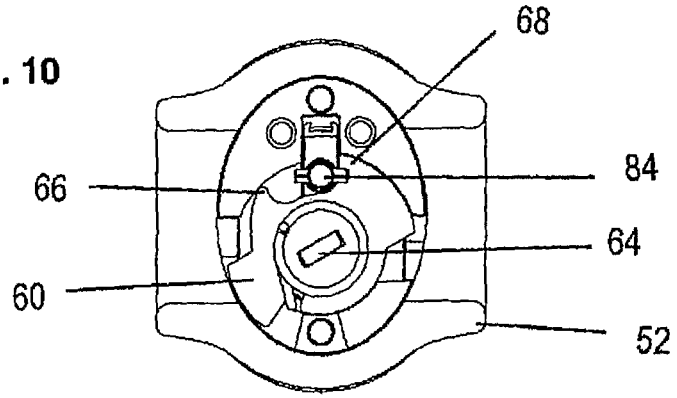
FIG. 10 is a cross-sectional view of FIG. 1 through section line A-A showing the disc in the second, unlocked position.
Figure 11:
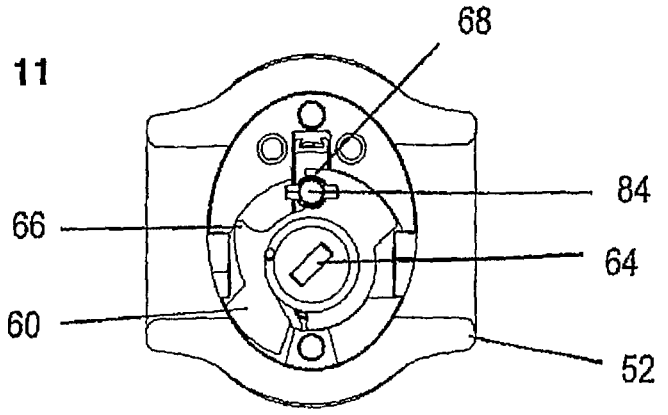
FIG. 11 is a cross-sectional view of FIG. 1 through section line A-A showing the locking disc in the third, unlocked and open position.
Figure 12:
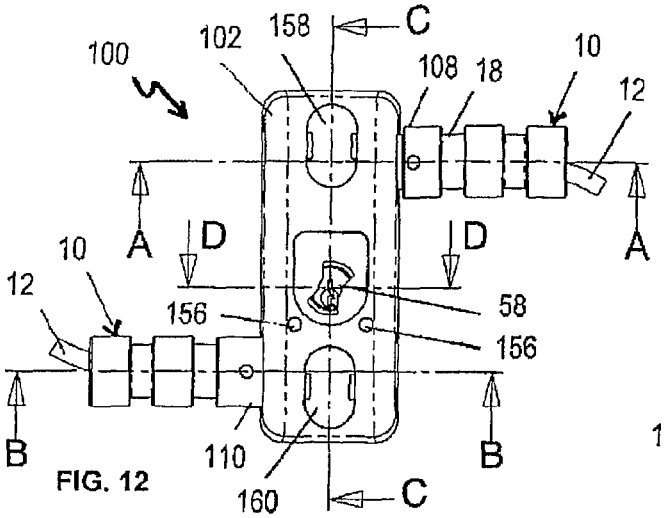
FIG. 12 is a front elevation of an embodiment of the lock mount assembly according to the third aspect of the invention.
Figure 13:
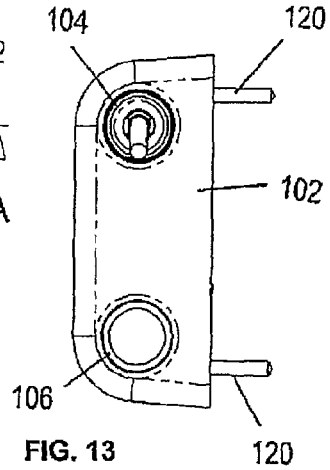
FIG. 13 is a right side elevation of the lock mount assembly of FIG. 12.
Figure 14:
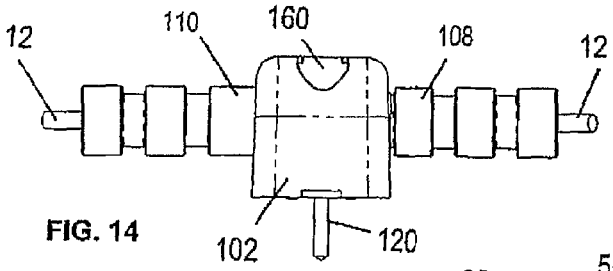
FIG. 14 is a bottom view of the lock mount assembly of FIG. 12.
Figure 16:
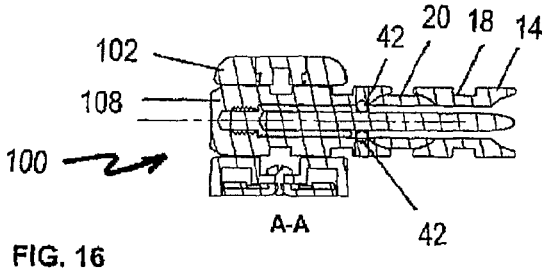
FIG. 16 is a cross-sectional view of FIG. 12 through section line A-A.
Figure 15:
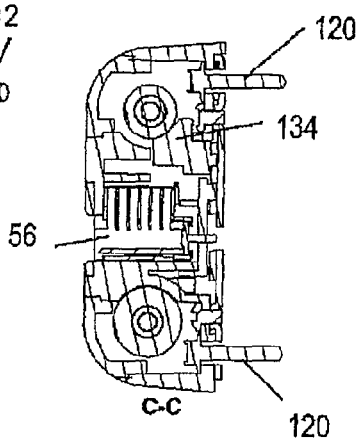
FIG. 15 is a cross-sectional view of FIG. 12 through section line C-C.
Figure 17:
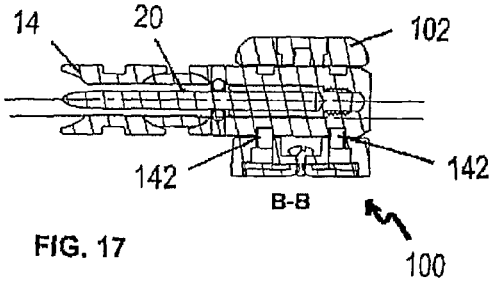
FIG. 17 is a cross-sectional view of FIG. 12 through section line B-B.
Figure 18:
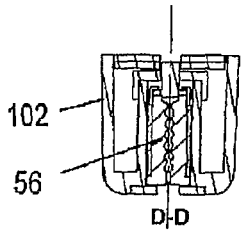
FIG. 18 is a cross-sectional view of FIG. 12 through section line D-D.

Locking assembly 50, which is also illustrated in FIGS. 1 to 8 as well as in FIGS. 9 to 11, has a lock body 52 of generally elliptical shape. Received within lock body 52 is lock housing 54. Locking mechanism 56 is rotatably mounted within lock housing 54. Locking mechanism 56 is preferably a pin tumbler or disk tumbler lock. As illustrated, locking mechanism 56 is of the pin tumbler type. Locking mechanism 56 is operable by a key (not shown) inserted through keyway 58.

Included in lock assembly 50 is disk 60. Disk 60 includes a central rectangular bore 62 which receives tail 64 of locking mechanism 56, so that disk 60 is rotatable by locking mechanism 56. Disk 60 includes first shoulder 66 and second shoulder 68 with cutout 70 between them. Disk 60 also includes a hole (indicated at 81 in FIG. 5) to accommodate first tail 74 of spring 76. The second tail 78 of spring 76 engages hole 80 (refer FIG. 5) of block 82, which is not rotatable within lock housing 54.

Lock assembly 50 also includes movable retaining means, being pin 84, biased by spring 86.

As best illustrated in FIGS. 9 to 11, pin 84 is engaged by shoulder 66 in the locked position (FIG. 9). In the unlocked position (FIG. 10), pin 84 is engaged by shoulder 68 of disk 60.

In the unlocked position, lock housing 54 is released from engagement from lock body 52 and is partly ejected from lock body 52 by springs 77. Tongue 88 (FIG. 2) is withdrawn from engagement in locking recess 18 which, in this illustration, is in end housing 38. It is to be appreciated that any of recesses 18 in end housing 38, or in first armour element 14, or cylindrical part 22 of second armour element 20, may have been chosen for locking within lock assembly 50.

When first end 34 is removed from lock body 52 and lock housing 54 is moved back to the locked position, pin 84 is accessible through either aperture 53 or 55 provided in lock body 52. A pick or other suitable tool can be used to engage in aperture 90 in pin 84 and withdraw pin 84 from engagement with second shoulder 68 of disk 60. This enables disk 60 to assume the position shown in FIG. 11, which fully releases lock housing 54 from lock body 52. This gives full access to locking mechanism 56 and hence enables rekeying or placement of locking mechanism 56.

In FIGS. 7 and 8, lock assembly 50 and armoured cable assembly 10 are shown in situ locking gate 114 to fence 162. It will be appreciated by one skilled in the art that the combinations of lock assembly 50 with armoured cable assembly 10 facilitates control of security to, for example, a building site protected by fence 162 and gate 114.

Turning now to FIGS. 12 to 21, the armoured cable assembly 10 included in some of these Figures is essentially the same as that discussed above and the same numerals will be used. However, armoured cable assembly 10 in FIGS. 12 to 21 has two very similar ends. These are substantially the same as end 34 in the previous Figures, differing only in the number and configuration of locking recesses 18.

Lock mount assembly 100 includes housing 102 having first aperture 104 and second aperture 106, offset from first aperture 104.

First aperture 104 is designed to receive first end 108 of armoured cable assembly 10. Second aperture 106 is designed to receive second end 110 of armoured cable assembly 10. In this embodiment, there is a single cable assembly 10.

Lock mount assembly 100 includes pin tumbler locking mechanism 56 operable by a key (not shown) through keyway 58 and rotatably mounted within housing 102. Housing 102 is made from stainless steel and includes a base 112 for mounting onto a gate 114 (refer FIG. 20). Base 112 may be curved to accommodate the curve of gate edge 116 or may be made of suitable flexible material to form a close fit between base 112 and gate edge 116. Mounting screws 120, which pass through apertures 121 on base 112 and into gate 114, are accessible from inside lock mount assembly 100, but are designed to be inaccessible when armoured cable assembly 10 is locked into lock mount assembly 100.

Included in lock mount assembly 100 is disk 122. Like disk 60 in lock assembly 50, disk 122 includes a central rectangular bore 62 which receives tail 64 of locking mechanism 56, so that disk 122 is rotatable by locking mechanism 56. Disk 122 is attached to or integral with cam pin 124 which is received in cam groove 126 in plate 128. Attached to plate 128 by bolts 130 through holes 132 is first tongue 134. First tongue 134 represents the means for engaging first end 108 of armoured cable assembly 16 in first aperture 104.

Plate 128 includes four notches 138 and back plate 136 includes four notches 140, which align with notches 138. Back plate 136 is secured by screws 137 through apertures 139.

In this embodiment, the means for permitting disengagement of the second end 110 of cable assembly 10 includes two further tongues 142. These are joined by bridge 144. Bridge 144 includes a pair of pins 146. Two projections 148 are also on bridge 144. Two further projections 150 are on tongues 142.

When lock assembly 56 has been rotated by the key (not shown) to the unlocked position, tail 64, being inserted in aperture 62 of disk 122, through the interaction of cam pin 124 in cam groove 126, lowers plate 128 so that projections 148 and 150 are aligned with notches 138 and 140.

Springs 154 bias second tongues 142 away from plate 128 and back plate 136. The purpose of this is to bias lock mount assembly 100 to retain second end 110 in second aperture 106. To disengage second end 110, a pick or other suitable tool is inserted in apertures 156 in housing 102, to push pins 146 against the bias of springs 154. Pushing of pins 146 towards plate 128 and back plate 136 enables projections 148 and 150 to enter notches 138 and 140 and free second tongues 142 from engagement in locking recess 18 at second end 110 of armoured cable assembly 10.

Figure 19:
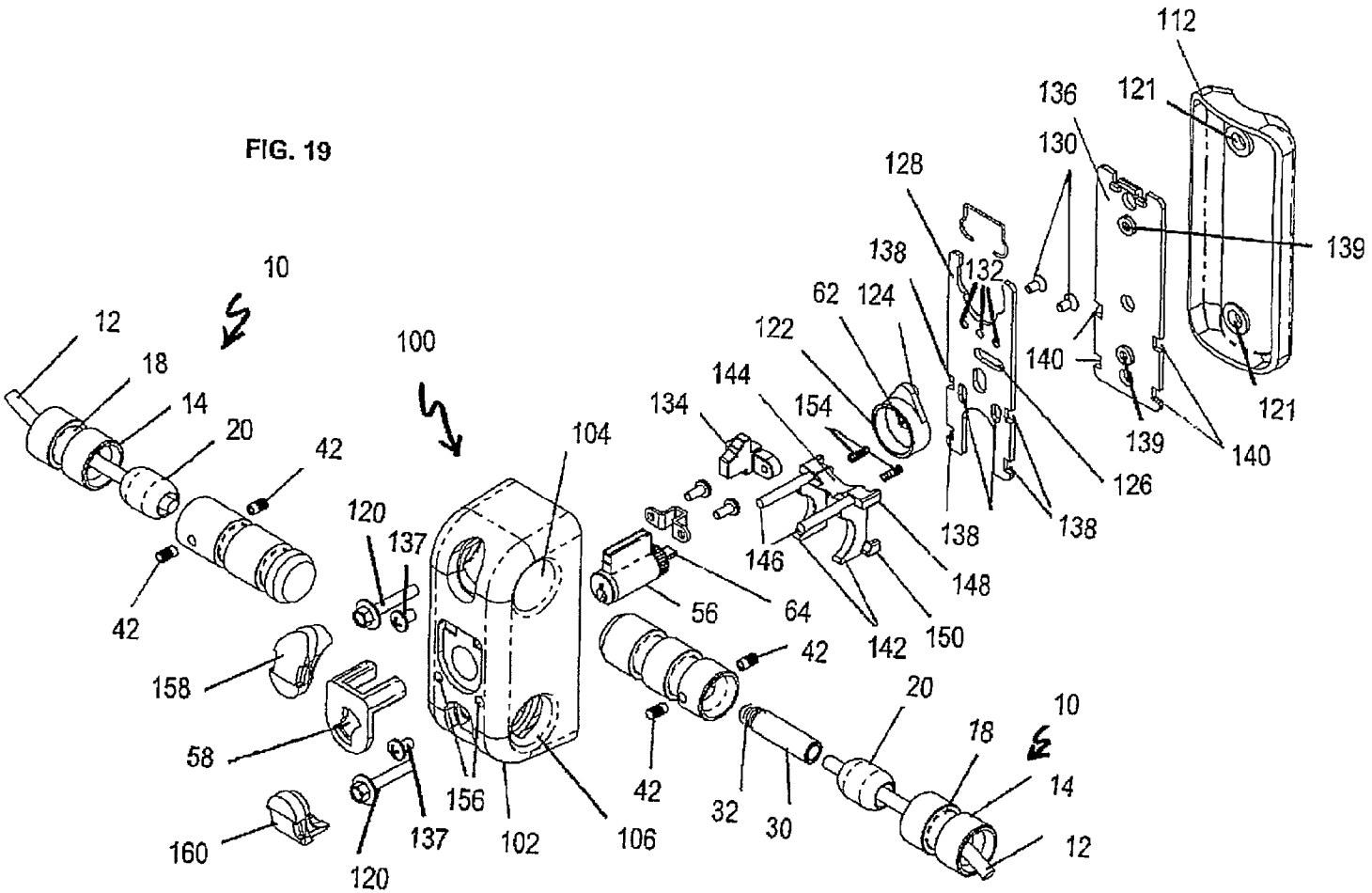
FIG. 19 is an exploded perspective view of the lock mount assembly of FIG. 12.

As shown in FIG. 19, lock mount assembly 100 includes push-in cover panels 158 and 160. These are made of suitable flexible material, such as synthetic rubber, and may present a neat appearance to lock mount assembly 100 as well as exclude contaminants and moisture from the parts contained within lock mount assembly 100.

Figure 20:
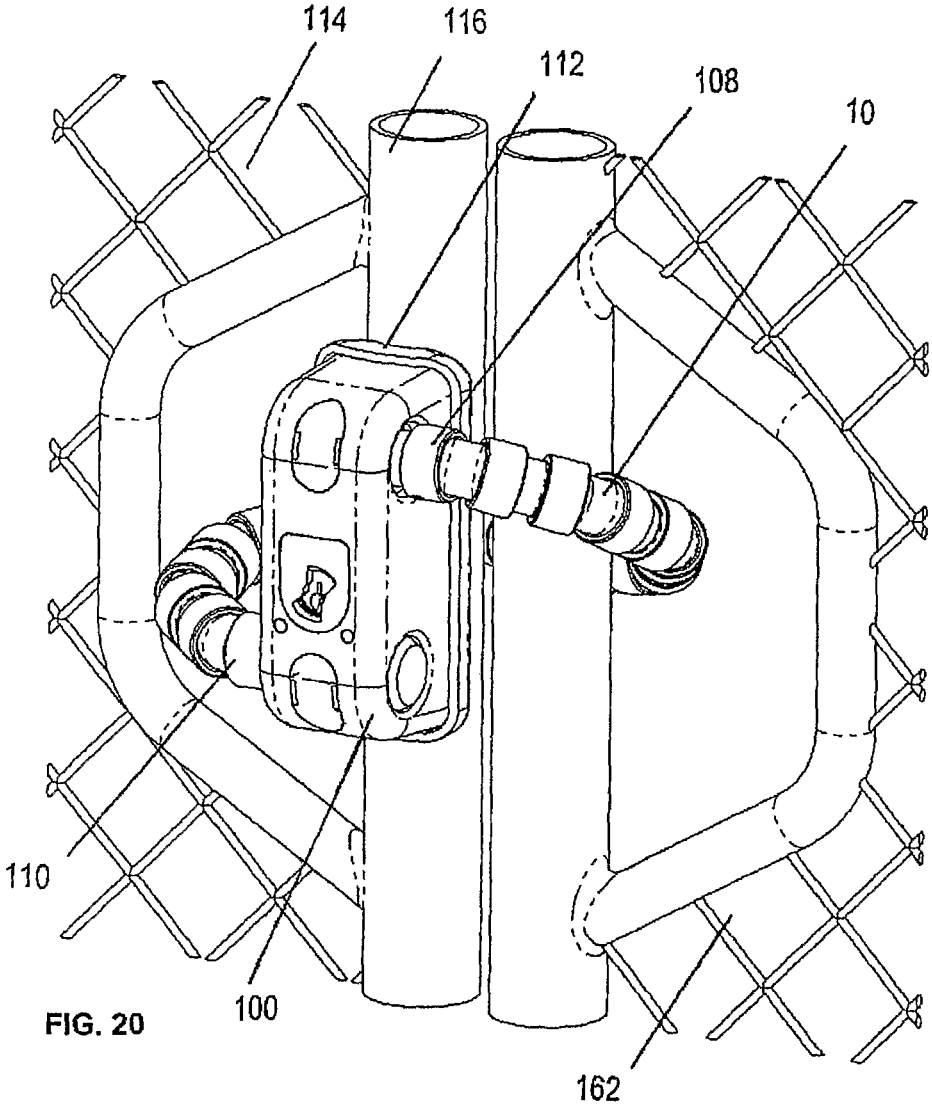
FIG. 20 is a perspective view of the lock mount assembly of FIG. 19, mounted to a gate.
Figure 21:
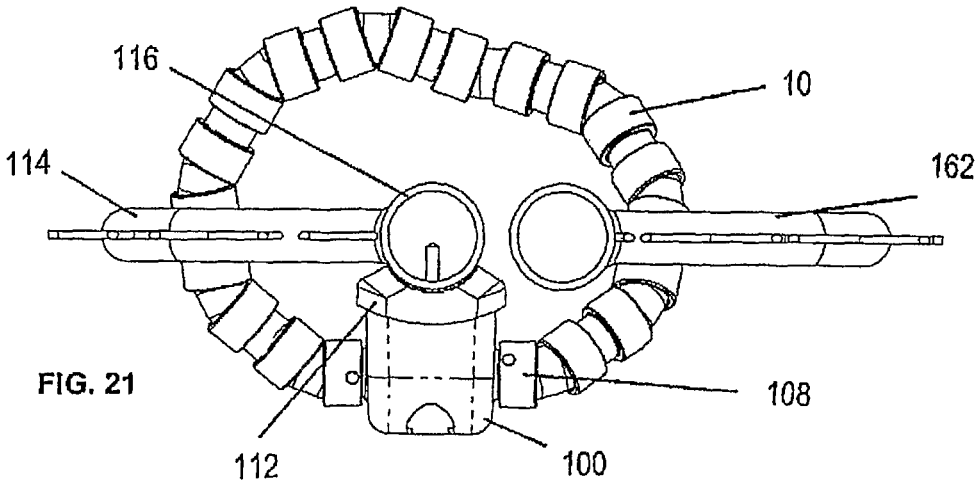
FIG. 21 is a top view of FIG. 20.

It will be appreciated, that during normal use, such as for securing gate 114 to fence 162, as shown in FIGS. 20 and 21, only first end 108 of armoured cable assembly 10 would be inserted in or removed from lock mount assembly 100. Only if armoured cable assembly 10 were to be replaced would it be necessary to unlock second end 110, by pushing against pins 146 as described above.

Reference is now made to the fourth aspect of the invention exemplified in FIGS. 22 to 29. In the first embodiment, in FIGS. 22 to 26, anchor 170 has an elliptoid housing 172 which includes a base 174. Base 174 has apertures 176 through which fastening means, being bolts 178, can be used to secure anchor 170 to a substrate, such as a concrete floor (not shown).

Housing 172 also includes aperture 180 passing through housing 172. Aperture 180 is generally parallel to base 174. However, openings 182 for aperture 180 are cut away as can be seen particularly in FIG. 24. The cut-away nature of openings 182 allows direct vertical access to each of bolts 178 when in situ. This makes it much easier to insert and remove bolts 178.

Figure 22:
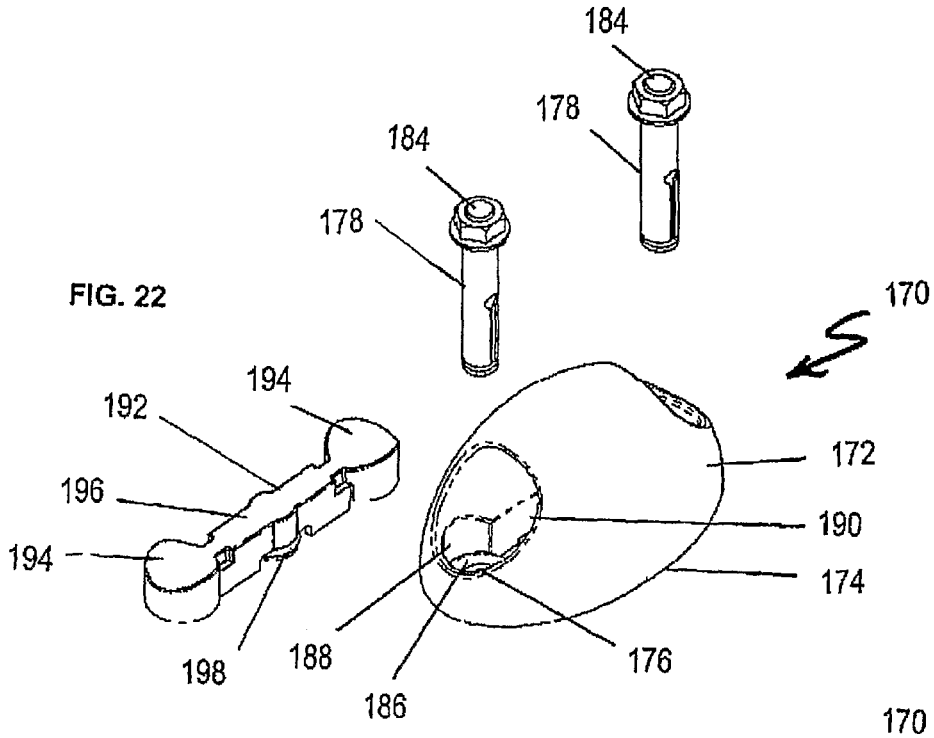
FIG. 22 is a perspective view of the components of an embodiment of the anchor according to the fourth aspect of the invention.
Figure 23:
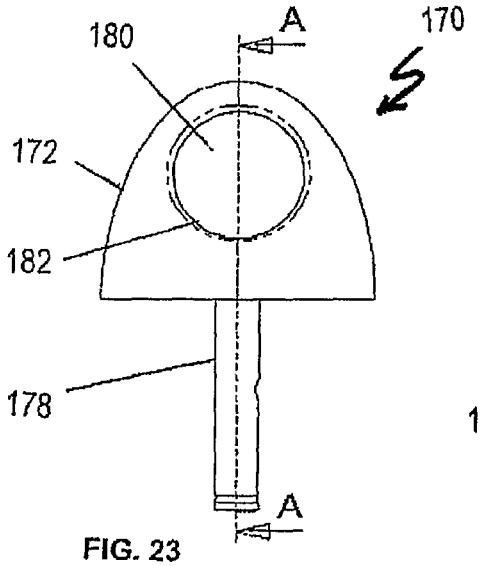
FIG. 23 is a side elevation of the anchor of FIG. 22, assembled.
Figure 24:
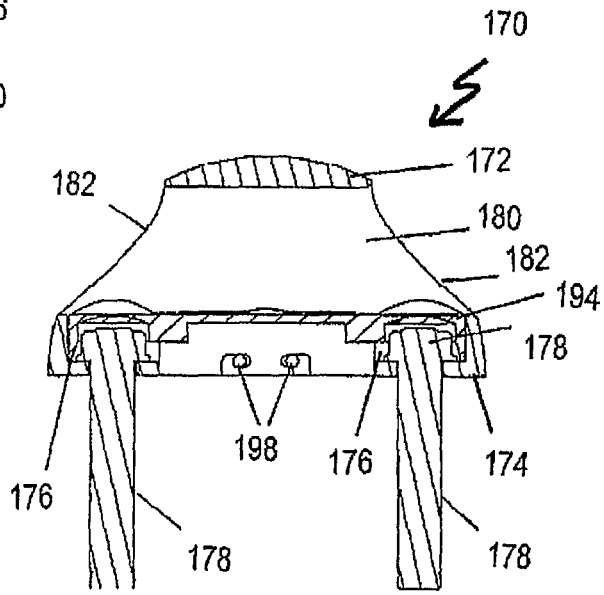
FIG. 24 is a cross-sectional view of FIG. 23 through section line A-A.

As may be seen in FIG. 22, base 174 of housing 172 includes a well for receiving head 184 of bolt 178. As illustrated, base 174 has a single well 186, having two wider portions 188, each shaped to accommodate head 184 of bolt 178, and narrow portion 190 joining wider portions 188. In a different embodiment, narrow portion 190 could be omitted, which would lead to separate wells, each resembling wider portion 188.

Anchor 170 also includes cover 192. As can best be seen in FIG. 22, cover 192 has two wider portions 194 joined by bridge 196. Cover 192 is shaped to fit closely within well 186, with wider portions 194 shaped to accommodate head 184 of bolt 178 (refer FIG. 24).

Cover 192 includes o-ring 198 (FIGS. 22 and 24) to help retain cover 192 in well 186 during normal use. If it is desired to remove bolts 178, cover 192 can be prised out of well 186.

It will be appreciated that if there were two separate wells in base 174 as described above, two separate covers, each resembling wider portion 194, would be provided.

Figure 26:
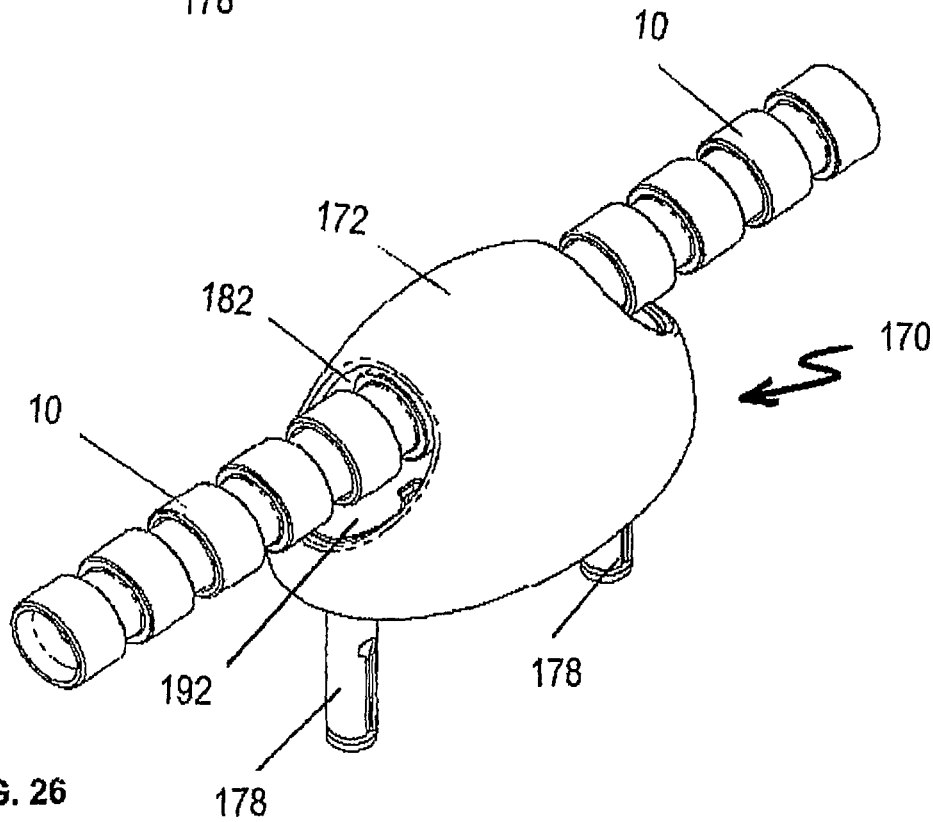
FIG. 26 shows the anchor in FIG. 25 with an armoured cable passing through the aperture.

As can be seen from FIG. 26, when armoured cable assembly 10 is inserted through first opening 182, through aperture 180 and out of second opening 182, provided cable assembly 10 is of sufficient diameter, cover 192 cannot be removed from well 186 and access to bolts 178 is restricted. When cable assembly 10 is unlocked from a locking assembly (not shown) and can be removed from aperture 180, cover 192 can be prised away from well 186, giving access to bolts 178.

Figure 25:
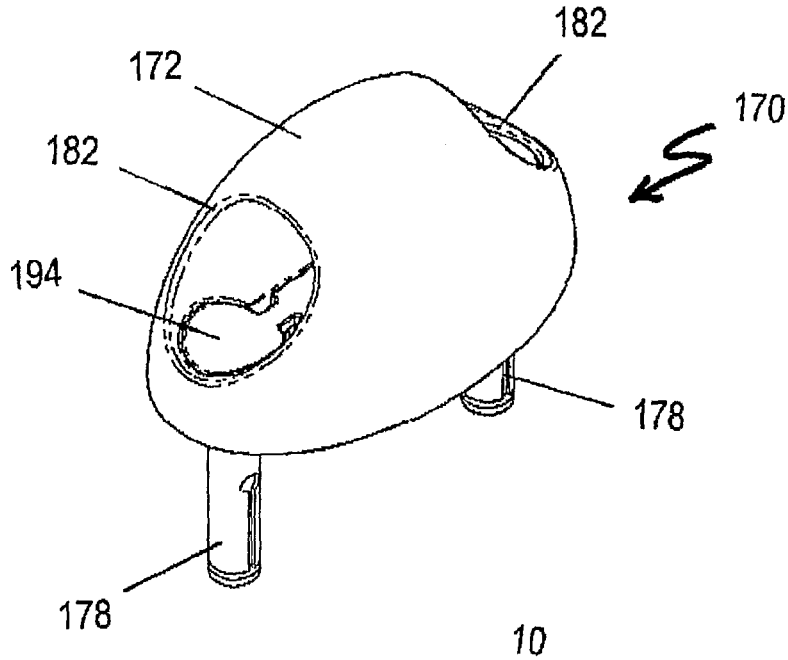
FIG. 25 is a perspective view of the anchor of FIG. 22, assembled.

Reference is now made to the second embodiment of the fourth aspect of the invention, exemplified in FIGS. 27 to 29. In general, the embodiment in FIGS. 27 to 29 is similar to that in FIGS. 22 to 26. FIGS. 25 and 26 adequately illustrate the anchor assembled and the anchor with an armoured cable passing through the aperture for the second embodiment, and have not been repeated.

In the embodiment in FIGS. 27 to 29, anchor 270 has an elliptoid housing 272 which includes a base 274. Base 274 has apertures 276 through which fastening means, being bolts 278, can be used to secure anchor 270 to a substrate, such as a concrete floor (not shown).

Housing 272 also includes aperture 280 passing though housing 272. Aperture 280 is generally parallel to base 274. However, openings 282 for aperture 280 are cut away as can be seen particularly in FIG. 29. The cut-away nature of openings 282 allows direct vertical access to each of bolts 278 when in situ. This makes it much easier to insert and remove bolts 278.

As may be seen in FIG. 27, base 274 of housing 272 includes a well for receiving head 284 of bolt 278. As illustrated, base 274 has a single well 286 having two wider portions 288, each shaped to accommodate head 284 of bolt 278. Each wider portion 288 is joined by a narrow portion 290 to a central wider portion 291. These shapes are designed to accommodate cover 292.

Cover 292, as best seen in FIG. 27, has two wider portions 294, each joined by two narrow bridges 296 to central wider portion 297. Cover 292 is shaped to fit closely within Well 286, with wider portions 294 shaped to accommodate head 284 of bolt 278 (refer FIG. 29).

Member 299 is shown in FIGS. 27 and 29. Member 299 has a base 293 and a curved portion 295. Curved portion 295 is designed to fit snugly within the dome of housing 272 (refer especially FIG. 29). Member 299 is designed to be inserted in housing 272 before bolts 278 are fastened through housing 272 into a substrate (not shown). Cover 292 is then put in position in well 286. Screw 287 is inserted through aperture 285 in cover 292 and through aperture 289 in member 299, in order to secure cover 292 to member 299. Because of the snug fit of member 299 within housing 272, cover 292 cannot be manipulated to remove it from covering bolts 278 and therefore bolts 278 are inaccessible if an armoured cable assembly is inserted through housing 272, as in FIG. 26.

It is to be appreciated that changes may be made to the invention in its various aspects without departing from the spirit and scope of the invention as disclosed herein.

INDUSTRIAL APPLICABILITY

As will be readily appreciated by those skilled in the various arts, the inventions disclosed herein are not limited to the examples set out and have wide applications in many areas, representing significant advances in the relevant art. In particular, the inventions provide armoured cable assemblies, locking assemblies, mounting systems and anchors which are far more sophisticated compared to prior art armoured cable assemblies, locking assemblies, mounting systems and anchors, permitting the application of modern technology.

The invention claimed is:

1. A locking assembly for use with an armoured cable assembly, the locking assembly including:

a lock body;

a lock housing receivable within the lock body;

a locking mechanism operable by a key and rotatably mounted within the lock housing; and a disk rotatable by the locking mechanism when operated by the key to a first locked position, a second unlocked position in which the lock housing is partially extractable from the lock body, and a third position in which the lock housing is fully removable from the lock body;

wherein:

the locking assembly includes a retaining means engageable by the disk, the disk having a first shoulder for engaging the retaining means in the first locked position and a second shoulder for engaging the retaining means in the second unlocked position; and the retaining means is movable out of engagement with the disk to enable rotation of the disk to the third position.

2. The locking assembly of claim 1, wherein the locking mechanism includes a pin tumbler or disk tumbler locking mechanism operable by a key.

3. The locking assembly of claim 1, wherein the retaining means is a pin.

4. The locking assembly of claim 3, further comprising an aperture for insertion of part of the armoured cable assembly.

5. The locking assembly of claim 4, wherein the aperture passes through the lock body and is shaped to allow direct vertical access to the retaining means.

6. The locking assembly of claim 4, wherein the armoured cable assembly includes an armour element having a recessed portion for locking into the locking assembly.

7. The locking assembly of claim 6, wherein the recessed portion is releasable from the locking assembly when the disk is rotated to the second unlocked position.

8. The locking assembly of claim 4, wherein the retaining means is accessible through the aperture when the aperture is not occupied by the part of the armoured cable assembly.

* * * * *